US006719465B2

(12) United States Patent
Earle et al.

(10) Patent No.: US 6,719,465 B2
(45) Date of Patent: Apr. 13, 2004

(54) ROTATING PROCESSOR

(75) Inventors: Anthony Earle, Harrow Weald (GB); Leslie R. Wells, Bounds Green (GB); Daniel M. Pagano, Honeoye Falls, NY (US); Ralph L. Piccinino, Jr., Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/244,315

(22) Filed: Sep. 16, 2002

(65) Prior Publication Data

US 2003/0053807 A1 Mar. 20, 2003

(30) Foreign Application Priority Data

Sep. 18, 2001 (GB) ..... 122457

(51) Int. Cl.[7] ..... G03D 3/02; G03D 3/04

(52) U.S. Cl. ..... 396/625; 396/626; 396/635; 355/27; 355/29

(58) Field of Search ..... 396/604–606, 396/609, 625–627, 633–635; 430/30, 399, 400; 355/27–29, 40, 41, 77; 134/64 P, 64 R, 122 P, 122 R

(56) References Cited

U.S. PATENT DOCUMENTS

| | | | | |
|---|---|---|---|---|
| 3,709,138 A | | 1/1973 | Brasher | |
| 3,727,535 A | | 4/1973 | Streeter | |
| 4,003,070 A | * | 1/1977 | Merz et al. | 396/622 |
| 5,692,188 A | | 11/1997 | Watts et al. | |
| 6,091,480 A | | 7/2000 | Vanous et al. | |

FOREIGN PATENT DOCUMENTS

| | | |
|---|---|---|
| DE | 3102074 | 8/1982 |

* cited by examiner

*Primary Examiner*—D. Rutledge
(74) *Attorney, Agent, or Firm*—Frank Pincelli

(57) ABSTRACT

A processor has a rotatable drum housed within an enclosure chamber. Processing solution is applied to the surface of the rotating drum and forms a film of solution around the periphery. The media to be processed is fed around the periphery of the rotating drum with its sensitized surface facing the drum.

22 Claims, 2 Drawing Sheets

ROTATING PROCESSOR

CROSS REFERENCE TO RELATED APPLICATIONS

This is a U.S. original patent application which claims priority on Great Britain patent application No. 0122457/5 filed Sep. 18, 2001.

FIELD OF THE INVENTION

The invention relates to the field of photographic processing, in particular to drum processors.

BACKGROUND OF THE INVENTION

Drum processors arc well known apparatus for developing paper photographic prints. In this known apparatus the drum is mounted and rotated so that its bottom edge dips into a tray of processing solution. As the drum rotates the motion thereof lifts up the solution on to its surface. The solution is carried around the periphery of the drum and returned to the tray. The paper to be processed is held against the top of the drum floating on this liquid film. The paper is normally held stationary by a fixed backing sheet.

The longest length of paper that can be accommodated by this type of processing device is governed by the maximum length of the drum surface clear of solution. Longer lengths have to pass further around the drum but it has been found that when they pass through the solution tray they leave the drum surface and get lost. If the lengths of paper are guided through the solution and up the other side of the drum uneven processing can occur. These problems do not occur normally with processing sheets having a maximum length of 12 inches (~30.5 cm) but the diameter of the drum becomes excessive if a long length needs to be processed.

This invention aims to reduce the diameter of drum type processors. This is especially useful when processing long lengths of paper or other photographic media.

SUMMARY OF THE INVENTION

According to the present invention there is provided apparatus for processing photographic media including a rotatable drum housed within an enclosure chamber, the chamber having a first opening and a second opening, means, located at the first opening of the chamber, for applying processing solution to the surface of the drum and means for feeding and withdrawing the photographic media to and from the enclosure chamber and around the periphery of the drum, the sensitised side thereof facing the drum.

The present invention further provides a method of processing photographic material comprising the steps of applying processing solution to the outer surface of a rotating drum to form a film of solution around a substantial part of the periphery thereof, the drum being housed in an enclosure chamber, feeding the media to be processed into the chamber and around the periphery of the drum to lie above the film of solution, the sensitised side of the media being in contact with the film of solution, and withdrawing the media from the chamber.

Preferably the solution is re-circulated around the surface of the drum.

Preferably the solution is fed into the top of the enclosure chamber as this provides gravity assisted wetting.

This invention overcomes the excessive diameter required by known processors. The processing solution is preferably supplied to the top of the drum by pumping it from a drain sump at the bottom. Less solution is required than by prior art processors. The application of solution can be controlled. The solution can be applied to both sides of the material. The processor is self loading and as it is smaller than those known in the prior art it requires less energy to heat and run. There are also less moving parts to the processor.

The processor allows the solutions to be changed very easily to optimise the processing.

It is advantageous to have the solution run around the circumference of the drum.

BRIEF DESCRIPTION OF THE DRAWINGS

The invention will now be described, by way of example, with reference to the accompanying drawings, in which.

DETAILED DESCRIPTION OF THE INVENTION

Figure 1:
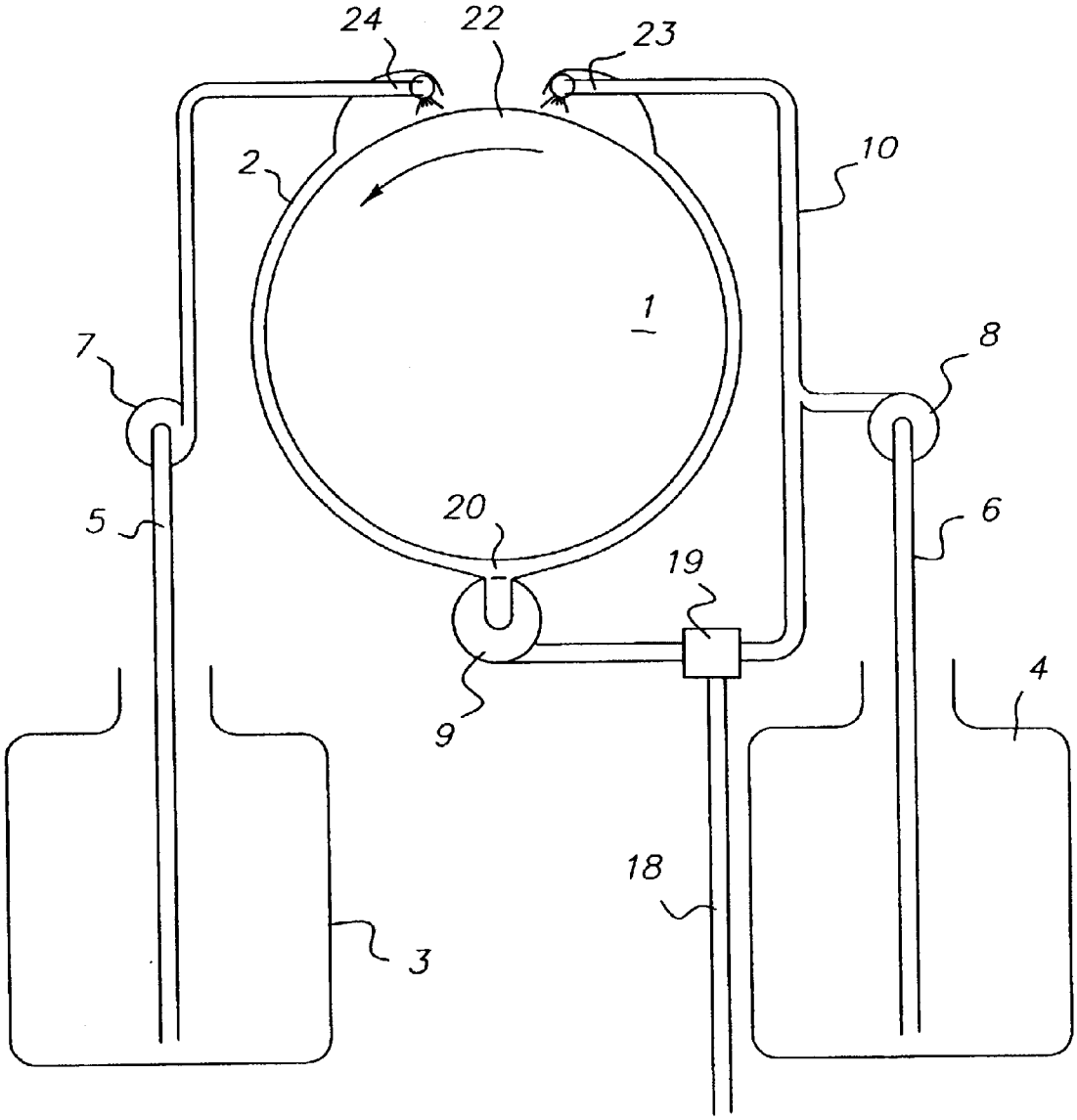
FIG. 1 is a schematic view of a processor according to the invention.

FIG. 1 is a schematic view of the general arrangement of the processor.

A rotatable processing drum 1 is housed within a housing or enclosure chamber 2. The radius of the drum is such that the circumference is substantially the same as the length of photographic media to be processed. The surface of the drum is smooth. The enclosure chamber 2 is provided with an opening 22 at the upper side thereof for entry of the photographic media to be processed. The opening 22 can be located anywhere around the periphery of the enclosure chamber 2 but the method of the invention works best when the opening is at the top. A further opening 20 is provided at the bottom of the enclosure chamber 2. The gap between the outer surface of the processing drum 1 and the inner wall of the enclosure chamber 2 lies in the range of 1 mm to 200 mm for most of the circumference. The gap widens around the opening 22. The gap also widens at opening 20 so that a puddle of solution does not form.

In the embodiment illustrated an external circulation loop 10 connects the top and bottom of the enclosure chamber 2 between opening 20 and opening 22. Application means, such as a spray bar 23, is provided at the upper end of the loop 10, within the enclosure chamber 2. This is shown in more detail in FIG. 3. The circulation loop includes pump 9. This may be located at the bottom end of the loop. A valve arrangement 19 is also included in the loop. The valve 19 is in connection with a waste pipe 18. If the waste from each solution is to be kept separate, e.g. for silver bearing waste to be collected separately, valve 19 could be a manifold with separate waste pipes 18.

A reservoir 4 is connected to the circulation loop 10 via pipe 6 and pump 8. The chemical solutions required for processing are stored in the reservoir 4. A separate reservoir 4, pipe 6 and pump 8 is required for each solution, i.e developer, bleach, fix, wash solution etc. Only one is shown in FIG. 1 for simplicity. A second reservoir 3 is connected via pipe 5 and pump 7 to the top of the enclosure chamber 2. Further wash solution is stored in reservoir 3. Application means, such as a spray bar 24, is provided at the end of pipe 5 which terminates within the upper part of enclosure chamber 2 at the other side of opening 22 from application means 23.

Two reservoirs of wash solution are required in this embodiment in order to wash both the front and the back of the media being processed. Alternatively reservoir 3 may be dispensed with if the application means 23 is modified to be able to apply solution to both the front and the back of the media. This modification could, for example, be by means of using a solenoid valve which allows the solutions to be applied either in front of or behind the opening 22.

In operation a fixed volume of processing solution is pumped out of reservoir 4 by pump 8. The volume should be excess to that required for the processing to allow for take up swell in the material being processed. Also it is preferable to have sufficient solution for re-circulation. This ensures the drum does not dry out during the process.

The solution is pumped from the reservoir 4 into the circulation loop 10 and up to the opening 22 into enclosure chamber 2. The solution is applied to the surface of the drum 1 via spray bar 23. It is not necessary that the solution is sprayed. Application could be by other means, such as rollers, pads, a curtain of liquid, etc. The solution is applied to the drum just prior to where the photographic media, for example film, 14 is introduced. This could be anywhere around the drum but the invention works best when this is at the top of the enclosure chamber. The wetting is then assisted by gravity. The solution is drawn around the drum by the rotation of the drum. In operation the drum 1 is rotating continuously. The outer surface of the drum is continuously wetted by the processing solution. The surface speed of the drum is dependent on the viscosity of the solution being applied. The media is supported by the liquid bearing formed on the surface of the drum. The solution exits the enclosure chamber 2 via the opening 20 at the lower end of the enclosure and into the circulation loop 10. The solution is circulated around the loop and back through the enclosure chamber throughout the processing operation by pump 9. Once the drum is wetted with the processing solution the film 14 is loaded. The film is loaded by means of drive rollers, not shown. As the drum rotates faster than the film is fed on by the drive rollers it is possible for the processing solution to be applied simultaneously as the film is fed and still have the same effect. The film is fed relatively slowly in comparison with the speed of the drum.

Figure 2:
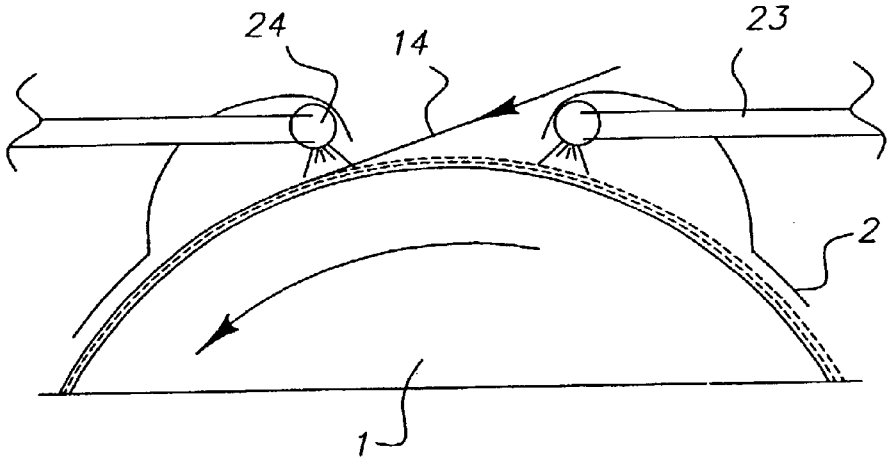
FIG. 2 is a close up view of the top of the processor.

It can be seen in FIG. 2 that the solution is fed between the film and the drum. As the film 14 enters into the enclosure chamber it passes right around the circumference of the drum 1, floating on the solution. The film is fed in with the sensitised surface towards the drum. The film is kept on the drum by attraction to the solution, which lies between the drum and the film. This is a distinct advantage over the prior art where the media passes through a reservoir of solution and would often fall off. The relative motion between the drum and the film causes agitation.

It is possible to feed the film 14 onto the drum at an angle such that a spiral is formed. This would further reduce the diameter of the drum required for processing although the width would have to increase. In this case it would be necessary to ensure that the spray applicator 23 covers the whole width of the drum.

The rotation of the drum tries to pull the film out of the cassette. However the end of the film may remain attached to its cartridge as it is held in position by the rollers. Once the film is loaded it does not move further.

At no time is there sufficient solution in the system to form a puddle of solution at the lower part of the enclosure chamber. The system is drained between each processing solution by opening the valve 19 and allowing the solution to pass through to the waste pipe 18. The next solution required by the process is then fed into the circulation loop 10 from the next reservoir 4 and thus onto the drum 1. This is done quickly and the drum does not dry out between solutions. The drum continues to rotate with the film floating on the residue of solution.

After the film has been processed it needs to be washed. It can be seen from FIG. 4 that in this embodiment the wash water for washing the back of the film is applied from the spray applicator 24. Wash water for washing the front of the film is applied from spray applicator 23, to the sensitised side of the film. Once the film has been washed the drive rollers are reversed and the film is unloaded from the processor. It is possible to continue supplying wash water as the film is removed. Wash water could also be applied directly to the surface of the drum between films.

Preferably the drum is heated. In this case excess solution will be required due to evaporation. The drum can be heated directly or the whole enclosure chamber can be heated. The drum may be heated by having a hot liquid contained therein. Due to the thermal mass of the drum the processing solutions are heated almost instantaneously as they come into contact with the drum. This improves the life of the chemical solutions as they are not sitting in tanks at the operating temperature prior to use. No pre-heating of the solution is required.

There are no fixed path lengths in the processor. It is therefore possible to vary the timing of each of the process steps to optimise the processing of the media. The timing can be varied allowing for accommodation of under and over exposure. This information can be found by, for example, the magnetic strip of an APS film or from an infra-red detector in the processor which can identify silver development.

It is easy to vary the chemical process because there are no fixed tanks. The invention can be used with conventional development, RX development, with negative film, transparency film etc.

Figure 3:
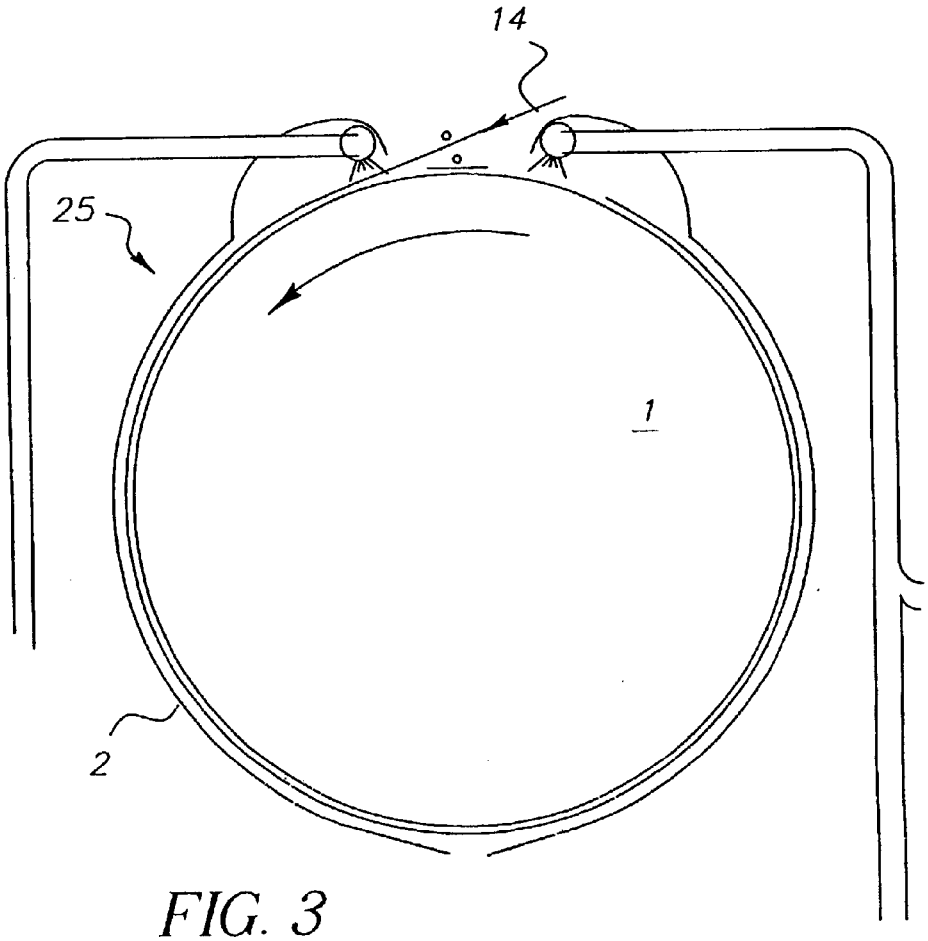
FIG. 3 is a schematic view of a second embodiment of a processor according to the invention.

The invention is applicable to all photographic media, for example, APS film, 35 mm film, 120 mm film or paper. The invention can also be used with thicker, stiff webs of material. If these stiffer webs of material are reluctant to follow the curvature of the drum a flexible cover 25 can be provided and positioned around the drum. This is illustrated in FIG. 3.

It is possible for the processor to work continuously, i.e. one film after another.

The invention has been described in detail with reference to preferred embodiments thereof. It will be understood by those skilled in the art that variations and modifications can be effected within the scope of the invention.

Parts List

1 processing drum
2 chamber
3 reservoir
4 reservoir
5 pipe
6 pipe
7 pump
8 pump
9 pump
10 circulation loop
14 film
18 waste pipe
19 valve arrangement

20 opening
22 opening
23 spray bar
24 spray bar
25 cover

What is claimed is:

1. Apparatus for processing photographic media including a rotatable drum housed within an enclosure chamber, the chamber having a first opening and a second opening, means, located at the first opening of the chamber, for applying processing solution to the surface of the drum and means for feeding and withdrawing the photographic media to and from the enclosure chamber and around the periphery of the drum, the sensitised side thereof facing the drum.

2. Apparatus as claimed in claim 1 including a circulation system external to the chamber for circulating the solution from the second opening to the first opening for re-application to the surface of the drum.

3. Apparatus as claimed in claim 1 wherein means for applying wash solution is located at the first opening of the chamber.

4. Apparatus as claimed in claim 1 wherein the first opening of the enclosure chamber is located at the upper half thereof.

5. Apparatus as claimed in claim 1 wherein solution is applied by spray means.

6. Apparatus as claimed in claim 1 wherein solution is applied by roller means.

7. Apparatus as claimed in claim 1 wherein solution is applied by means of pads.

8. Apparatus as claimed in claim 1 including means for heating the rotatable drum.

9. Apparatus as claimed in claim 8 wherein the drum contains a heated liquid.

10. A method of processing photographic material comprising the steps of applying processing solution to the outer surface of a rotating drum to form a film of solution around a substantial part of the periphery thereof, the drum being housed in an enclosure chamber, feeding the medium to be processed into the chamber and around the periphery of the drum to lie above the film of solution, the sensitised side of the medium being in contact with the film of solution, and withdrawing the medium from the chamber.

11. A method as claimed in claim 10 including the step of re-circulating the solution around the surface of the drum.

12. A method of processing photographic material as claimed in claim 10 wherein wash solution is applied to the medium prior to withdrawal from the chamber.

13. A method of processing photographic material as claimed in claim 10 wherein solution is applied to the top half of the drum.

14. A method of processing photographic material as claimed in claim 10 wherein the material is fed onto the periphery of the drum at an angle to form a spiral.

15. A method of processing photographic material as claimed in claim 10 wherein more than one processing solution is applied serially to the outer surface of the drum, the previous solution being drained from the enclosure chamber before the next is applied.

16. A method of processing photographic material as claimed in claim 10 wherein the solution is sprayed onto the drum.

17. A method of processing photographic material as claimed in claim 10 wherein the solution is applied to the drum by means of rollers.

18. A method of processing photographic material as claimed in claim 10 wherein the solution is applied to the drum by means of pads.

19. A method of processing photographic material as claimed in claim 10 wherein the medium is washed simultaneously as it is withdrawn.

20. A method of processing photographic material as claimed in claim 10 wherein the rotatable drum is heated, the solution being heated on contact with the surface of the drum.

21. A method of processing photographic material as claimed in claim 20 wherein the drum is heated by hot air.

22. A method of processing photographic material as claimed in claim 20 wherein the drum is heated by a hot liquid contained therein.

* * * * *